United States Patent [19]

Barmatz et al.

[11] Patent Number: 4,573,356

[45] Date of Patent: Mar. 4, 1986

[54] SINGLE TRANSDUCER LEVITATOR

[75] Inventors: Martin B. Barmatz, Glendale; James L. Allen, LaCrescenta; Mark S. Gaspar, Glendale, all of Calif.

[73] Assignee: California Institute of Technology, Pasadena, Calif.

[21] Appl. No.: 627,537

[22] Filed: Jul. 3, 1984

[51] Int. Cl.[4] ..... G10K 15/00

[52] U.S. Cl. ..... 73/505

[58] Field of Search ..... 73/505

[56] References Cited

U.S. PATENT DOCUMENTS

| | | | |
|---|---|---|---|
| 3,164,022 | 1/1965 | Ensley | 73/505 |
| 3,232,120 | 2/1966 | Ensley | 73/505 |
| 3,882,732 | 5/1975 | Fletcher et al. | 73/505 |
| 4,393,708 | 7/1983 | Barmatz et al. | 73/505 |
| 4,475,921 | 10/1984 | Barmatz | 23/313 R |

OTHER PUBLICATIONS

R. R. Whymark, "Acoustic Field Positioning for Containerless Processing", *Ultrasonics,* Nov. 1975, pp. 251–261.

*Vibration and Sound* by P. M. Morse (McGraw Hill, N.Y., 1948) p. 399.

*Primary Examiner*—Stewart J. Levy

*Assistant Examiner*—John E. Chapman, Jr.

*Attorney, Agent, or Firm*—Freilich, Hornbaker, Rosen & Fernandez

[57] ABSTRACT

A method is described for using acoustic waves to hold an object in position against wandering in any direction, by the use of a single transducer. Formulas are provided for levitating an object along an axis of a rectangular or cylindrical chamber or the center of a spherical chamber. The formulas take into account the relative volume of the object to the chamber.

32 Claims, 8 Drawing Figures

FIG. 1
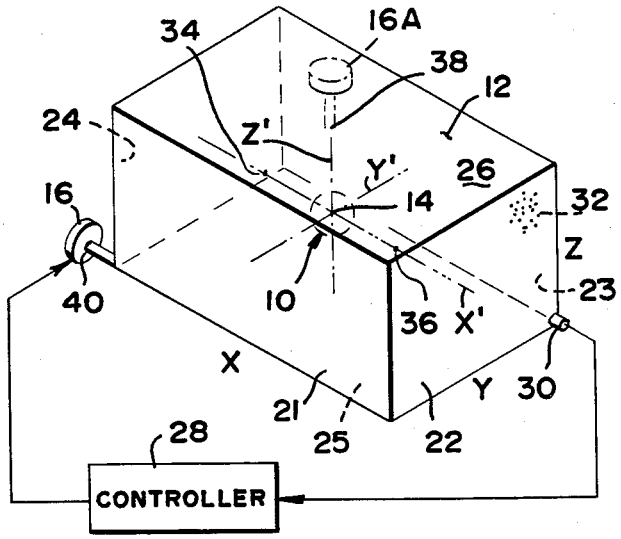
FIG. 2
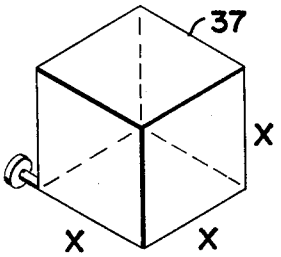
FIG. 5
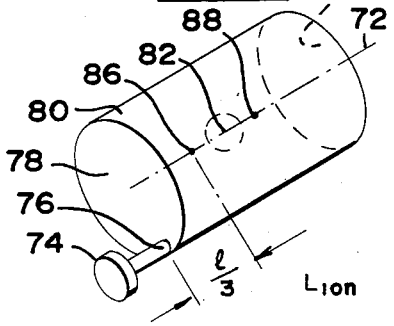
FIG. 3
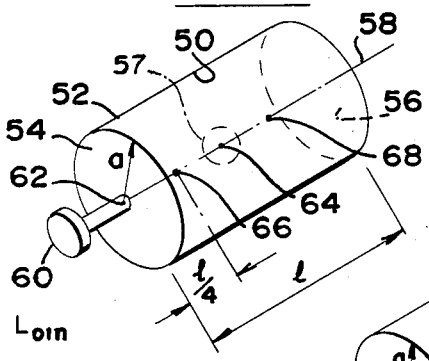
FIG. 6
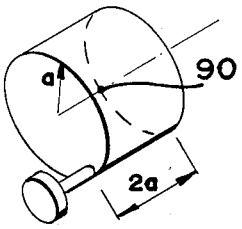
L102 = 1.725a
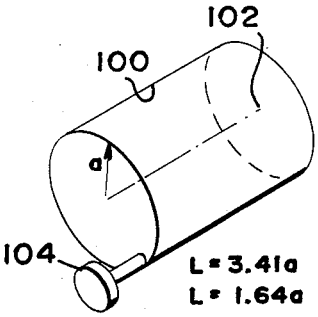
FIG. 8
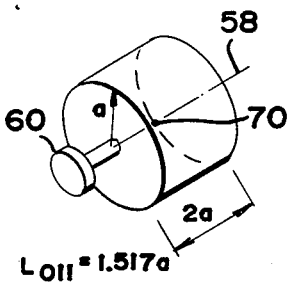
L011 = 1.517a
FIG. 4
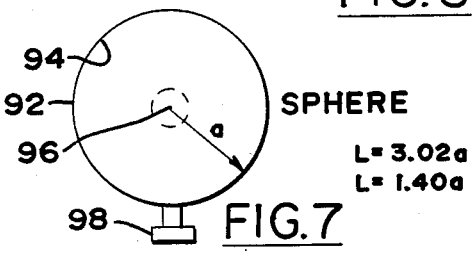
FIG. 7

SINGLE TRANSDUCER LEVITATOR

BACKGROUND OF THE INVENTION

Acoustic levitation of an object within a chamber has heretofore been accomplished by the use of a plurality of standing wave patterns. For example, in a chamber of rectangular cross-section, three standing wave patterns have been established along each of the three dimensions of the chamber, in order to support the object in a vertical direction and to keep it from wandering in either the X or Y directions. The need to use three transducers complicates the system. This is especially true where the sample is to be heated so that the frequency outputs of the transducers have to be changed to follow the change in resonant frequency with temperature. A system which enabled a single transducer to levitate an object in chambers of a wide range of relative dimensions, would be of considerable value.

SUMMARY OF THE INVENTION

In accordance with one embodiment of the present invention, a method and apparatus are provided for levitating an object within a chamber by the use of a single transducer. Equations are given for calculating the wave length required to levitate an object along an axis of a chamber of rectangular cross-sections and a chamber of cylindrical shape. An equation is also provided for the levitation of an object at the center of a spherical chamber. The wavelength is dependent upon not only the dimensions of the chamber, but also by where along an axis of a chamber it is desired to levitate the object, and also by the ratio of the volume of the object to the volume of the chamber.

The novel features of the invention are set forth with particularity in the appended claims. The invention will best be understood from the following description when read in connection with the accompanying drawings.

BRIEF DESCRIPTION OF THE DRAWINGS

FIG. 1 is a perspective view of levitation apparatus of one embodiment of the present invention, for a chamber of arbitrary rectangular cross-sections.

FIG. 2 is a perspective view of apparatus similar to that of FIG. 1, but wherein the chamber is of cubic shape.

FIG. 3 is a perspective view of apparatus for levitating an object within a cylindrical chamber, using one series of levitation modes.

FIG. 4 is a perspective view of apparatus similar to that of FIG. 3, but wherein the diameter of the chamber equals its length.

FIG. 5 is a perspective view of apparatus for levitating an object within a cylindrical chamber, which is similar to that of FIG. 3 except that a different series of levitation modes are utilized.

FIG. 6 is a perspective view of apparatus similar to that of FIG. 5, but with the diameter of the chamber equal to its length.

FIG. 7 is an elevation view of apparatus for levitating an object at the center of a sphere.

FIG. 8 is a perspective view of levitation apparatus constructed in accordance with another embodiment of the invention, for urging an object towards the axis of a cylinder.

DESCRIPTION OF THE PREFERRED EMBODIMENTS

FIG. 1 illustrates a system for levitating an object 10 within a chamber 12 of rectangular cross-sections near a location 14 which lies at the center of the chamber. The system includes a single transducer 16 coupled to one corner of the chamber and driven at a frequency which produces a closely determined wavelength L within the chamber. The wavelength is chosen so that the output of the single transducer 16 establishes a standing wave pattern which positions the object along all three dimensions X, Y, Z of the chamber. The ability to use a single transducer to levitate an object along all three dimensions greatly simplifies the apparatus for levitating the object.

The chamber 12 is formed by six walls 21–26 with adjacent walls perpendicular to one another, to form a parallelepiped of rectangular cross-sections. In one example, the transducer 16 is an electrically driven voice coil type, which is driven by a controller 28 having a variable frequency output. An acoustic sensor such as a microphone 30 is located to sense the intensity of the standing wave pattern within the chamber, and its output is connected to the controller 28. The controller 28 can vary the frequency, so that the frequency of the transducer 16 is very close to the frequency of a particular resonant mode which results in levitation of the object 10 away from the walls of the chamber. The controller does this by slightly increasing and/or decreasing the frequency to maintain maximum microphone output. While there are a large number of frequencies and corresponding wavelengths which will establish a standing wave pattern within the chamber, only a very limited number of them will levitate an object away from the walls of the chamber, and an even lower number that will levitate an object at the center of the chamber or along a predetermined axis such as X'. For a typical chamber having a "Q" of about 100, the frequency must be within 1% of the resonant frequency in order to apply at least about ⅓rd of the maximum levitation force to the levitated object. Accordingly, it is important that the initial frequency applied by the transducer to the chamber, be close to the frequency which produces levitation at the desired position within the chamber. The controller 28 can then track the resonant frequency of the mode, to maintain the precise resonant frequency despite changes such as due to changes in temperature. The present invention is directed to the determination of wavelengths which will produce levitation at selected positions within the chamber which are away from the walls of the chamber.

In a first relatively simple situation, it can be assumed that the object 10 has a volume $V_s$ which is very small compared to the volume $V_c$ of the chamber 12, such as less than 1% of the chamber volume. The chamber 12 must be filled with a fluid, either gaseous or liquid, in order to use acoustics to levitate the object within the chamber, and it may first be assumed that the object 10 is of greater density than the fluid 32 which fills the chamber. The denser object is also assumed to have less compressibility than the surrounding fluid, which is so for almost all solid materials. The object 10 will be levitated along an axis X' which extends along the X dimension of the chamber at a location half-way between the side walls 21, 23 and half-way between the top and bottom walls 26, 25, by applying a wavelength $L_{n21}$ given by the following equation:

$$L_{n21} = \frac{2X}{[n^2 + 4(X/Y)^2 + (X/Z)^2]^{\frac{1}{2}}} \quad \text{Eq. 1}$$

where X is the length of the chamber along the X' axis, Y is the width of the chamber, Z is the height of the chamber, and n is a positive integer that is 2 or greater. If n equals 2, which is the lowest mode for levitation along the X' axis, then the object will be levitated at the center point 14 which is halfway between opposite end walls 22, 24 of the chamber. Where the system is on the earth where there is considerable gravity urging the object downwardly, the center of the object will be slightly below the X' axis.

Where n equals 3, the object can be levitated at either one of two points, 34, 36 along the X' axis, where each point is X/3 from an end wall. The particular point to which an object will be urged by acoustic pressure, is determined by which of the two points the object is initially placed near. At higher modes, wherein n is greater, progressively more levitation points will be established within the chamber, at which an object can be levitated. It is generally desirable to use an n no greater than about 8, so that a definitive standing weight pattern can be maintained within the chamber with a limited number of known levitation points.

Equation one applies to chambers of rectangular cross-sections, regardless of whether the dimension X is larger or smaller than the others Y and Z. If it is desired to levitate an object along the width or height of the chamber, then one can merely call the width or height axis the X' axis. A simplified case is where a chamber is a cube, as at 37 in FIG. 2, so that all dimensions of the chamber are equal and each side of the chamber may be stated to have a length X. It may be assumed that in such a chamber it is desired to levitate an object of greater density than the fluid in the chamber and of a very small volume compared to the total volume of the chamber, at the center of the chamber. In that case, the wavelength L is given by the following:

$$L_{221} = 2X/3 \quad \text{Eq. 2}$$

In the above equations 1 and 2, it was assumed that the volume of the sample was very small compared to the volume of the chamber. In many applications, it is desirable to use a sample or object having a volume which is a significant portion of the volume of the chamber. As a first approximation, the wavelength required to establish a particular resonant mode increases by one and one-fourth times the ratio of the volume of the sample to the volume of the chamber. However, other lesser factors are involved, including the ratio of the area of the sample to the cross-sectional area of the chamber. A close approximation, which is within about 1% of the wavelength for a volume of the sample of up to about 20% of the volume of the chamber, is given by the following equation:

$$\frac{dL_{n21}}{L_{n21}} = 1.29 \frac{V_s}{V_c} \quad \text{Eq. 3}$$

where $$\frac{dL_{n21}}{L_{n21}}$$

is the percent increase in the wavelength, over the wavelength $L_{n21}$ in Equation 1, $V_s$ is the volume of the sample (one or more objects), and $V_c$ is the volume of the chamber. This applies to a typical object which has a length, width, and height that are all of the same order of magnitude. Thus, if the volume of the sample is 10% of the volume of the chamber, then the wavelength required to achieve the desired resonant mode, will increase by about 12.6% over the resonant wavelength when the sample had a very small volume of less than 1% of the chamber volume. Equation 3 is accurate within about 1% for samples having a volume up to about 20% of the volume of the chamber. As mentioned earlier, a typical "Q" of a chamber is 100, so that a 1% error in wavelength will result in a levitation force that is about ⅓rd of the maximum value obtainable at the precisely correct resonant wavelength. An error of only 1% will be close enough that significant levitating forces will be generated, and a feedback system of the type shown in FIG. 1 will easily be able to adjust the wavelength to be precisely equal to the wavelength that produces maximum levitation force.

The maximum levitation force is generated when the transducer 16 is coupled (through tube 40) to a corner of the rectangular chamber, or to the center of one of the walls of the chamber. If the transducer were coupled to any other location, the levitation force would be lower. In FIG. 1, the transducer is shown at 16A coupled to a location 38 which is at the center at the wall 21 on the Y' axis. The coupling of the transducer to this location can sometimes be easier than coupling it to a corner of the chamber. It may be noted that transducers may be coupled through a tube 40 to the chamber. Instead of a tube, a solid horn can be used to carry acoustic waves of a limited wavelength. Such intermediate coupling devices are useful to enable application of very high acoustic energy, and also to isolate the transducer from elevated temperatures that may exist within the chamber.

FIG. 3 illustrates another embodiment of the invention, wherein the chamber 50 is a cylindrical chamber formed by a cylindrical side wall 52 and flat end walls 54, 56. There are two types of resonant modes which generate at least one levitation position along the axis 58 of the cylindrical chamber. A first set of modes is established by applying acoustic energy with a transducer 60 to the middle 62 of an end wall of the chamber, and with the wavelength given by the following equation:

$$L_{01n} = \frac{2a}{[1.488 + n^2(a/l)^2]^{\frac{1}{2}}} \quad \text{Eq. 4}$$

where a is the radius of the cylinder, l is the length of the cylinder, and n is a positive integer of one or more. When n equals 1, a levitation position for object or sample 57 is at the chamber center 64, which is halfway between the opposite end walls 54, 56. When n equals 2, the levitation positions 66 and 68 are spaced by a distance 1/4 from adjacent end walls 54 or 56. This can be useful where two molten samples are levitated, one at 66 and the other at 68, and with the mode then changed to n=1 to bring the samples together all without contamination from a solid crucible. Where the volume of the sample $V_s$ is appreciable, such as at least about 1% of the volume of the chamber $V_c$, the adjustment of equation 3 should be applied for volumes of the sample up to about 20% of the volume of the chamber. Thus, the complete expression for levitation along the axis of the chamber 50 of FIG. 3 is given by the following equation for sample volumes of up to about 20% of the volume of the chamber:

$$L_{01n} = \frac{2a}{[1.488 + n^2(a/l)^2]^{\frac{1}{2}}}\left(1 + 1.29\frac{V_s}{V_c}\right) \quad \text{Eq. 5}$$

One relatively simple situation, shown in FIG. 4, is the levitation of a sample at a central point 70 of a chamber of the type shown in FIG. 3, but wherein the length of the chamber is twice the radius a of the chamber, or in other words the length and diameter of the chamber are equal. In that case, the wavelength required for such levitation is given by the following equation:

$$L_{011} = 1.517a\left(1 + 1.29\frac{V_s}{V_c}\right) \quad \text{Eq. 6}$$

FIG. 5 shows another levitation system for levitating an object along the axis 72 of a cylindrical chamber. In this case the transducer 74 is coupled to a location 76 which is at a corner where an end wall 78 and the round side wall 80 of the chamber meet. For small sample volumes, the wavelength is given by the following equation:

$$L_{10n} = \frac{2a}{[0.344 + n^2(a/l)^2]^{\frac{1}{2}}} \quad \text{Eq. 7}$$

where n is a positive integer equal to two or more, and the other values a and l are the radius and the length of the chamber. The number of levitation points is equal to n−1, so that when n=2, an object is levitated at the center point 82 of the chamber wherein it is halfway between the opposite end walls 78 and 84 of the chamber. When n=3, objects are levitated at the locations 86, 88 that are spaced 1/3 from each end wall. The same adjustment for the effects of considerable volume to about 20%, is made as for the other cylindrical chamber, and is as shown in equation 3. Thus, the complete expression for the wavelength is as given below:

$$L_{10n} = \frac{2a}{[0.344 + n^2(a/l)^2]^{\frac{1}{2}}}\left(1 + 1.29\frac{V_s}{V_c}\right) \quad \text{Eq. 8}$$

One relatively simple set of perameters for the system of FIG. 5, is the specific system shown in FIG. 6, wherein the length and diameter of the chamber are equal. In that case, the equation for the wavelength which will levitate a sample at the center 90 of the chamber is as given by the following equation:

$$L_{102} = 1.725a\left(1 + 1.29\frac{V_s}{V_c}\right) \quad \text{Eq. 9}$$

FIG. 7 illustrates walls 92 that form a spherical chamber 94. An object can be levitated at the center 96 of the sphere by the use of an acoustic transducer 98 which applies acoustic energy of a wavelength given by the following equation:

$$L = 3.02a \quad \text{Eq. 10}$$

where a is the radius of the sphere. Where the volume of the sample is appreciable, the same adjustment of equation 3 can be used for sample volumes of up to about 20% of the chamber volume, to provide the following complete expression:

$$L = 3.02a\left(1 + 1.29\frac{V_s}{V_c}\right) \quad \text{Eq. 11}$$

where the symbols a, $V_s$, and $V_c$ are the radius of the chamber, the volume of the sample, and the volume of the chamber, respectively. The transducer should be applied to the top or bottom of the chamber where the object is to be levitated primary against the force of gravity.

FIG. 8 shows a cylindrical chamber 100, wherein a standing wave pattern is established which urges objects towards the axis 102 of the cylinder, but which does not control the position of the object along the axis 102. For objects of a density greater than the fluid in the medium, levitation of the object along the axis 102 is achieved by using a transducer 104 coupled to where an endwall and the round side wall meet, and which generates an acoustic wave of a wavelength equal to 3.41a, where a is the radius of the chamber. For an object or objects of considerable volume, the adjustment of equation 3 can be applied so that the wavelength is given by the following equation:

$$L = 3.41a\left(1 + 1.29\frac{V_s}{V_c}\right) \quad \text{Eq. 12}$$

where the symbols a, $V_s$, and $V_c$ are the radius, volume of the object, and volume of the chamber, respectively.

All of the above equations have applied to situations where the object has a greater density than the density of the fluid (gaseous or liquid) that fills the chamber. There are some specialized applications where it is desirable to urge an object towards an axis of a chamber, but where the object has a smaller density than the fluid which fills the chamber. For example, it is sometimes desirable to urge one or more bubbles of gas towards the axis of a liquid-filled chamber. Many of the same equations given above for cases where the object has greater density than the fluid, can be used, but with certain modifications and with the bubble or other light object levitating at a different position than in the case of objects more dense than the fluid. For the chamber of FIG. 1 of rectangular cross-section, an object lighter than the surrounding fluid can be levitated along an axis X′ by applying acoustic waves of the following wavelength:

$$L_{n22} = \frac{2X}{[n^2 + 4(X/Y)^2 + 4(X/Z)^2]^{\frac{1}{2}}}\left(1 + 1.29\frac{V_s}{V_c}\right) \quad \text{Eq. 13}$$

where n is a positive integer that is at least 2 (and preferably no more than 8), X, Y, and Z are the three dimensions of the chamber, and $V_s/V_c$ is the ratio of the volume of the light object to the volume of the chamber. Levitation at the point 14 in FIG. 1, at the center of the chamber, is achieved when n equals 2, so levitation of a light object at the center is achieved when the following wavelength is applied:

Eq. 14

$$L_{222} = \frac{X}{[1 + (X/Y)^2 + (X/Z)^2]^{\frac{1}{2}}}\left(1 + 1.29\frac{V_s}{V_c}\right)$$

where the symbols are the same as for equation 13.

For the cylindrical chamber of FIG. 3 which is driven by a transducer 60 coupled to the center 62 of an endwall of the chamber, an object 57 is levitated along the axis 58 of the chamber by applying equations 4 or 5, but with a somewhat different result. The wavelength is as given below:

Eq. 5

$$L_{01n} = \frac{2a}{[1.488 + n^2(a/l)^2]^{\frac{1}{2}}}\left(1 + 1.29\frac{V_s}{V_c}\right)$$

where a, l, $V_s$ and $V_c$ are the radius of the chamber, length of the chamber, volume of the sample, and volume of the chamber, respectively. n is a positive integer which must be 2 or more (but not more than about 8). When n=2, the bubble is levitated at the center point 64 of the chamber. This may be compared with the situation that exists when an object denser than the surrounding fluid is levitated, where the use of n=2 results in levitation at two points 66, 68 that are away from the center.

For the system of FIG. 5, wherein the transducer 74 is applied to a corner of the chamber where an end wall and side wall of the chamber meet, a bubble or other object lighter than the surrounding fluid in the chamber can be levitated by applying acoustic energy of a wavelength defined by equation 8, but with somewhat different results. That is, a bubble can be levitated by applying a wavelength given by the following equation:

Eq. 8

$$L_{10n} = \frac{2a}{[0.344 + n^2(a/l)^2]^{\frac{1}{2}}}\left(1 + 1.29\frac{V_s}{V_c}\right)$$

where n is a positive integer equal to 1 or more (preferably not more than 8). The symbols a, l, $V_s$, and $V_c$, are the radius, length, volume of the sample, and volume of the chamber, respectively. For n=1, a bubble will be levitated at the center 82 of the chamber. For an object of greater density surrounding fluid, the equation with n=1 will not result in levitation within the chamber.

In FIG. 7, wherein the chamber 94 is spherical, an object of lesser density than the surrounding fluid which fills the chamber, can be levitated at the center 96 of the chamber by applying a wavelength given by the following equation:

Eq. 15

$$L = 1.40a\left(1 + 1.29\frac{V_s}{V_c}\right)$$

where a is the radius of the sphere, $V_s$ is the volume of the sample, and $V_c$ is the volume of the chamber.

An object of lesser density than the surrounding fluid can be levitated in the chamber of FIG. 8, wherein the object is urged towards the axis of the chamber but not at any particular points therealong, by applying a wavelength given by the following equation:

Eq. 16

$$L = 1.64a\left(1 + 1.29\frac{V_s}{V_c}\right)$$

where a is the radius of the chamber and $V_s$ and $V_c$ are the volume of the sample and volume of the chamber, respectively.

Thus, the invention provides methods and apparatus for levitating objects within chambers of rectangular cross-sections, cylindrical chambers, and spherical chambers. Where desired, a single transducer can be employed to levitate an object at a unique location within the chamber. Expressions for the wavelengths are given which are accurate for objects that are up to about 20% of the total volume of the chamber. In practice, it is important primarily to initially apply a wavelength close to that of the desired resonant mode, such as within a few percentage (3%) and preferably within about 1% of the precise resonant wavelength, with a feedback loop being used to adjust the wavelength so that it is maintained very close to the resonant value. In the case of rectangular and cylindrical chambers, a single transducer can generally be driven to levitate objects at one or more points along an axis of the chamber. It is generally desirable to limit the wavelength and number of levitation points by using a value for the symbol n of no more than about 8.

Although particular embodiments of the invention have been described and illustrated herein, it is recognized that modifications and variations may readily occur to those skilled in the art. Consequently, it is intended that the claims be interpreted to cover such modifications and variations.

What is claimed is:

1. A method for levitating an object within a fluid-filled chamber formed by walls that form a chamber of rectangular cross-sections having lengths X, Y, and Z, where the object is to be levitated substantially along an axis X′ that extends along the center of the chamber in the X direction, and where the object is denser than the fluid and occupies less than 20% of the volume of the chamber, comprising:

applying acoustic energy to said chamber of a wavelength $L_{n21}$ given by the following equation:

$$L_{n21} = \frac{2X}{[n^2 + 4(X/Y)^2 + (X/Z)^2]^{\frac{1}{2}}}\left(1 + 1.29\frac{V_s}{V_c}\right)$$

where n is a positive integer that is between 2 and 8, and $V_s/V_c$ is the ratio of the volume $V_s$ of the object and the volume $V_c$ of the chamber.

2. The method described in claim 1 wherein:

said step of applying acoustic energy includes coupling a transducer which produces said energy, to a corner of the chamber.

3. The method described in claim 1 wherein:

said step of applying acoustic energy includes coupling a transducer which produces said energy, to the center of one of the four sides of the chamber through which the X′ axis does not pass.

4. The method described in claim 1 wherein:

the wavelength of acoustic energy is within about 1% of the value $L_{221}$ given by the following equation:

$$L_{221} = \frac{2X}{[4 + 4(X/Y)^2 + (X/Z)^2]^{\frac{1}{2}}}\left(1 + 1.29\frac{V_s}{V_c}\right)$$

whereby to levitate at the center of the chamber.

5. The method described in claim 1 wherein:

said walls form a cubic chamber in which all chamber dimensions X, Y, and Z are equal, and wherein $$L = \frac{2}{3} \times (1 + 1.29\ V_s/V_c)$$

6. The method described in claim 1 wherein:

n equals 3, wherein to enable levitation at locations spaced by X/3 from opposite end walls.

7. A method for levitating a sample substantially in the center of a chamber of rectangular cross-section having dimensions X, Y, and Z, which is filled with a fluid, where the sample is denser than the fluid and occupies less than 20% of the volume of the chamber, comprising:

applying acoustic energy of a wavelength $L_{221}$ where $L_{221}$ is substantially as given by the following equation:

$$L_{221} = \frac{2X}{[4 + 4(X/Y)^2 + (X/Z)^2]^{\frac{1}{2}}}(1 + 1.29\ V_s/V_c)$$

where $V_s/V_c$ is the ratio of the volume $V_s$ of the sample to the volume $V_c$ of the chamber.

8. A method for levitating an object substantially along the axis of a cylindrical chamber at any of n points along the axis, where the chamber is filled with fluid and the object has a greater density than the fluid and occupies less than 20% of the volume of the chamber, comprising:

applying acoustic energy to said chamber of a wavelength $L_{01n}$ given by the following equation:

$$L_{01n} = \frac{2a}{[1.488 + n^2(a/l)^2]^{\frac{1}{2}}}\left(1 + 1.29\frac{V_s}{V_c}\right)$$

where a is the radius of the cylindrical chamber, l is the length of the chamber, n is a positive integer of 1 or more, $V_s$ is the volume of the sample, and $V_c$ is the volume of the chamber.

9. The method described in claim 8 wherein:

n=1 and the wavelength is given by the following equation:

$$L_{011} = \frac{2a}{[1.488 + (a/l)^2]^{\frac{1}{2}}}(1 + 1.29\ V_s/V_c)$$

whereby to levitate the object at the center of the chamber.

10. The method described in claim 9 wherein:

the length of the chamber equals twice its radius, n equals 1, and the wavelength is given by the following equation:

$$L_{011} = 1.517a\left(1 + 1.29\frac{V_s}{V_c}\right)$$

11. The method described in claim 8 wherein:

n equals 2 and the wavelength is given by the equation:

$$L_{012} = \frac{2a}{[1.488 + 4(a/l)^2]^{\frac{1}{2}}}\left(1 + 1.29\frac{V_s}{V_c}\right)$$

whereby to provide two levitation locations where the object can be levitated, with each location spaced a distance l/4 from an end wall of the chamber.

12. The method described in claim 8 wherein:

said step of applying acoustic energy includes coupling a transducer to the middle of an end wall of said chamber.

13. A method for levitating a sample substantially along the axis of a cylindrical chamber at any one of n−1 points along the axis, where the chamber is filled with a fluid and the sample has a greater density than the fluid and occupies less than 20% of the volume of the chamber, comprising:

applying acoustic energy to said chamber of a wavelength $L_{10n}$ given by the following equation:

$$L_{10n} = \frac{2a}{[0.344 + n^2(a/l)^2]^{\frac{1}{2}}}\left(1 + 1.29\frac{V_s}{V_c}\right)$$

where a is the radius of the cylindrical chamber, l is the length the chamber, n is a positive integer equal to 2 or more, $V_s$ is the volume of the sample, and $V_c$ if the volume of the chamber.

14. The method described in claim 12 wherein:

n=2 and the wavelength is given by the following equation:

$$L_{102} = \frac{2a}{[0.344 + 4(a/l)^2]^{\frac{1}{2}}}\left(1 + 1.29\frac{V}{V_c}\right)$$

whereby to levitate the object at the center of the chamber.

15. The method described in claim 14 wherein:

the length of the chamber equals twice its radius, n equals 2, and the wavelength is given by the following equation:

$$L_{102} = 1.725a\left(1 + 1.29\frac{V_s}{V_c}\right)$$

16. The method described in claim 13 wherein:

n equals 3 and the wavelength is given by the equation:

$$L_{103} = \frac{2a}{[1.488 + 9(a/l)^2]^{\frac{1}{2}}}\left(1 + 1.29\frac{V_s}{V_c}\right)$$

whereby to provide two levitation locations where the object can be levitated, with each location spaced a distance l/3 from an end wall of the chamber and from each other.

17. The method described in claim 13 wherein:

said step of applying acoustic energy includes coupling a transducer to the intersection between an end wall and a side wall of the chamber.

18. A method for levitating an object substantially along the axis of a cylindrical chamber at a location halfway between the opposite end walls of the chamber, where the chamber is filled with a fluid and the object has a greater density than the fluid and occupies less than 20% of the volume of the chamber, comprising:

applying acoustic energy to substantially the intersection between an end wall and the sidewall of the chamber of a wavelength L given by the following equation:

$$L_{102} = \frac{2a}{[0.344 + 4(a/l)^2]^{\frac{1}{2}}}\left(1 + 1.29\frac{V_s}{V_c}\right)$$

where a is the radius of the chamber, l is the length of the chamber, $V_s$ is the volume of the object and $V_c$ is the volume of the chamber.

19. A method for levitating an object substantially at the center of a spherical chamber, where the chamber is filled with a fluid and the object has a greater density than the fluid and occupies less than 20% of the volume of the chamber, comprising:

applying acoustic energy of a wavelength L approximately as given by the equation:

$$L = 3.02a\left(1 + 1.29\frac{V_s}{V_c}\right)$$

where a is the radius of the sphere, $V_s$ is the volume of the object, and $V_c$ is the volume of the chamber.

20. A method for urging an object toward the axis of a chamber of cylindrical cross-section where the chamber is filled with a fluid and the object has a greater density than the fluid and occupies less than 20% of the volume of the chamber, comprising:

applying acoustic energy of a wavelength L given by the equation $$L = 3.41a\left(1 + 1.29\frac{V_s}{V_c}\right)$$

where a is the radius of the cylindrical cross-section, $V_s$ is the volume of the object, and $V_c$ is the volume of the chamber.

21. A method for levitating an object within a fluid-filled chamber formed by walls that form a chamber of rectangular cross-sections having lengths X, Y and Z, where the object is to be levitated substantally along an axis X' that extends along the center of the chamber in the X direction, and where the object is of lesser density than the fluid and occupies less than 20% of the volume of the chamber, comprising:

applying acoustic energy to said chamber of a wavelength given by the following equation:

$$L_{n22} = \frac{2X}{[n^2 + 4(X/Y)^2 + 4(X/Z)^2]^{\frac{1}{2}}}\left(1 + 1.29\frac{V_s}{V_c}\right)$$

where n is a positive integer that is between 2 and 8, and $V_s/V_c$ is the ratio of the volume $V_s$ of the object and the volume $V_c$ of the chamber.

22. The method described in claim 21 wherein:

said object has a volume $V_s$ less than 20% of the volume of the chamber and the wavelength of acoustic energy is given by the following equation:

$$L_{222} = \frac{2X}{[4 + 4(X/Y)^2 + 4(X/Z)^2]^{\frac{1}{2}}}\left(1 + 1.29\frac{V_s}{V_c}\right)$$

whereby to levitate at the center of the chamber.

23. A method for levitating an object substantially along the axis of a cylindrical chamber, where the chamber is filled with a fluid and the object has a lesser density than the fluid and occupies less than 20% of the volume of the chamber, comprising:

applying acoustic energy to said chamber of a wavelength $L_{01n}$ given by the following equation:

$$L_{01n} = \frac{2a}{[1.488 + n^2(a/l)^2]^{\frac{1}{2}}}\left(1 + 1.29\frac{V_s}{V_c}\right)$$

where a is the radius of the cylindrical chamber, l is the length of the chamber, n is a positive integer of 2 or more, $V_s$ is the volume of the sample, and $V_c$ is the volume of the chamber.

24. The method described in claim 23 wherein:

said object has a volume $V_s$ which is less than 20% of the volume $V_c$ of the chamber, n equals 2, and the wavelength of the acoustic energy is given by the equation:

$$L_{012} = \frac{2a}{[1.488 + 4(a/l)^2]^{\frac{1}{2}}}\left(1 + 1.29\frac{V_s}{V_c}\right)$$

whereby to levitate the object halfway between the end walls of the chamber.

25. A method for levitating a sample substantially along the axis of a cylindrical chamber, where the chamber is filled with a fluid and the sample has a lesser density than the fluid and occupies less than 20% of the volume of the chamber, comprising:

applying acoustic energy to said chamber of a wavelength L given by the following equation:

$$L_{10n} = \frac{2a}{[0.344 + n^2(a/l)^2]^{\frac{1}{2}}}\left(1 + 1.29\frac{V_s}{V_c}\right)$$

where a is the radius of the cylindrical chamber, l is the length of the chamber, n is a positive integer equal to 1 or more, $V_s$ is the volume of the sample, and $V_c$ is the volume of the chamber.

26. The method described in claim 25 wherein:

said sample has a volume $V_s$ which is less than 20% of the volume $V_c$ of the chamber, n equals 1, and the wavelength of the acoustic energy is given by the equation:

$$L_{101} = \frac{2a}{[0.344 + (a/l)^2]^{\frac{1}{2}}}\left(1 + 1.29\frac{V_s}{V_c}\right)$$

whereby to levitate the object halfway between the end walls of the chamber.

27. A method for levitating an object substantially at the center of a spherical chamber, where the chamber is filled with a fluid and the object has a lesser density than the fluid and occupies less than 20% of the volume of the chamber, comprising:

applying acoustic energy of a wavelength, approximately as given by the equation $$L = 1.40a\left(1 + 1.29\frac{V_s}{V_c}\right)$$

where a is the radius of the sphere, $V_s$ is the volume of the object, and $V_c$ is the volume of the chamber.

28. Apparatus for levitating an object of a volume $V_s$ comprising:

six walls forming a chamber of rectangular cross-sections having dimensions of length X, Y and Z, wherein the volume of the chamber is more than 5 times the volume $V_s$ of the object;

a quantity of fluid filling said chamber, wherein the object has a greater density than the fluid;

acoustic transducer means coupled to said chamber, for generating acoustic energy of a wavelength which is approximately equal to the wavelength $L_{n21}$ given by the following equation:

$$L_{n21} = \frac{2X}{[n^2 + 4(X/Y)^2 + (X/Z)^2]^{\frac{1}{2}}}\left(1 + 1.29\frac{V_s}{V_c}\right)$$

where n is a positive integer that is in the range of 2 to 8 and $V_s/V_c$ is the ratio of the volume $V_s$ of the object and the volume $V_c$ of the chamber, whereby to levitate the object substantially along an axis X' that extends along the X dimension of the chamber through the middle of opposite walls of the chamber.

29. The apparatus described in claim 28 wherein:

said transducer is coupled to a corner of said chamber.

30. The apparatus described in claim 28 wherein:

said transducer is coupled to a center of a wall of said chamber.

31. Apparatus for levitating an object of a volume $V_s$ comprising:

walls forming a cylindrical chamber having a length l and radius a, wherein the volume of the chamber is more than 5 times the volume $V_s$ of the object;

a quantity of fluid filling said chamber, where the object has a greater density than the fluid;

acoustic transducer means coupled to the middle of an end wall of the chamber, for generating a wavelength which is approximately equal to the wavelength $L_{01n}$ given by the following equation:

$$L_{01n} = \frac{2a}{[1.488 + n^2(a/l)^2]^{\frac{1}{2}}}\left(1 + 1.29\frac{V_s}{V_c}\right)$$

where n is a positive integer that is in the range of 1 to 8, and $V_s/V_c$ is the ratio of the volume $V_s$ of the object and the volume $V_c$ of the chamber, whereby to levitate the object substantially along the axis of the chamber.

32. Apparatus for levitating an object of a volume $V_s$ comprising:

walls forming a cylindrical chamber having a length l and radius a, wherein the volume of the chamber is more than 5 times the volume $V_s$ of the object;

a quantity of fluid filling said chamber, where the object has a greater density than the fluid;

acoustic transducer means coupled to the intersection of the side wall and an end wall of the chamber, for generating a wavelength which is approximately equal to the wavelength $L_{10n}$ given by the following equation:

$$L_{10n} = \frac{2a}{[0.344 + n^2(a/l)^2]^{\frac{1}{2}}}\left(1 + 1.29\frac{V_s}{V_c}\right)$$

where n is a positive integer that is in the range of 2 to 8, and $(V_s/V_c)$ is the ratio of the volume $V_s$ of the object and the volume $V_c$ of the chamber, whereby to levitate the object substantially along the axis of the chamber.

* * * * *